United States Patent [19]

Kostylev et al.

[11] 4,174,758

[45] Nov. 20, 1979

[54] PERCUSSIVE ACTION PNEUMATIC DEVICE FOR DRILLING HOLES IN SOIL

[75] Inventors: Alexandr D. Kostylev; Nikolai P. Chepurnoi; Vladimir D. Plavskikh; Evgeny N. Cherednikov, all of Novosibirsk, U.S.S.R.

[73] Assignee: Institut Gornogo Dela Sibirskogo Otdelenia Akademii Nauk SSSR, U.S.S.R.

[21] Appl. No.: 866,864

[22] Filed: Jan. 4, 1978

[51] Int. Cl.[2] ..... E21B 11/02

[52] U.S. Cl. ..... 175/19; 403/349

[58] Field of Search ..... 175/19–23, 175/315; 173/46, 91, 132; 403/348, 349

[56] References Cited

U.S. PATENT DOCUMENTS

| | | | |
|---|---|---|---|
| 2,367,458 | 1/1945 | Coplen | 403/348 |
| 2,379,984 | 7/1945 | Nereaux | 403/348 |
| 2,902,832 | 9/1959 | Levy et al. | 175/19 X |
| 3,685,597 | 8/1972 | Kostylev et al. | 175/19 |

FOREIGN PATENT DOCUMENTS

| | | | |
|---|---|---|---|
| 2400522 | 9/1974 | Fed. Rep. of Germany | 403/349 |

*Primary Examiner*—Ernest R. Purser
*Assistant Examiner*—Richard E. Favreau
*Attorney, Agent, or Firm*—Robert E. Burns; Emmanuel J. Lobato; Bruce L. Adams

[57] ABSTRACT

The percussive action pneumatic device for drilling holes in a soil by compacting same has a cylinder-shaped housing with a conically pointed head portion. This pointed head portion of the housing is engaged in the internal surface of the tail portion of a hollow tip with a pointed end. A transverse partition is provided internally of the hollow tip, in the tail portion thereof, the head portion of the housing is detachably connectable with the transverse partition.

2 Claims, 4 Drawing Figures

PERCUSSIVE ACTION PNEUMATIC DEVICE FOR DRILLING HOLES IN SOIL

BACKGROUND OF THE INVENTION

The present invention relates to the art of construction and, more particularly, it relates to percussive action pneumatic devices for drilling holes in soils.

The invention can be utilized to utmost effectiveness for drilling holes in compactible soils.

At present, the practice of construction makes use of a variety of percussive action devices for drilling holes in soils.

A known percussive action pneumatic device comprises a cylindrical housing with a pointed head portion. The pointed end of the housing receives thereon a hollow cylindrical tip having a tail portion and a head portion. In most cases the tip has its head portion pointed, while the internal space of the tail portion has a conical or tapering surface adapted to engage about the housing. The diameter and length of the tip are selected to correspond to the diameter of the hole to be drilled.

Prior to a drilling operation, the selected tip is seated by its tapering surface onto the pointed head of the housing. Depending on the actual operating conditions, the pointed end of the tip is either placed against the soil surface or inserted into a previously dug hole. Then the percussive action pneumatic device is energized, and the hole is drilled. Upon the hole having been drilled, the percussive action pneumatic device is withdrawn therefrom. However, when either a vertical or a blind horizontal hole has been drilled, the tip remains in the hole, since it is practically impossible to withdraw it therefrom.

A disadvantage of the known device is this impossibility of recovering tips from blind holes, which significantly raises the cost of drilling holes.

SUMMARY OF THE INVENTION

It is an object of the present invention to provide a percussive action pneumatic device, which should provide for recovery of tips from blind holes.

This object is attained in a percussive action device for drilling holes in soils by compacting same, comprising a cylindrical housing with a conically pointed head portion, adapted to receive thereon the internal tapering surface of the tail portion of a hollow tip with a pointed head portion, in which apparatus, in accordance with the present invention, the head portion of the housing is detachably connected with a transverse partition provided internally of the tip, in the tail portion thereof.

This connection between the tip and the housing enables to withdraw the tip from a blind hole, and, should it be necessary, to detach it from the housing and replace with another tool or attachment.

It is expedient that the housing should have in the head portion thereof an axially projecting stem with a tapering head connected with the stem by the narrow portion thereof, with the transverse partition of the tip having made therein a tapering axial opening with slots providing for the passage of the head therethrough, the latter having substantially parallel flats cut thereon, the detachable connection between the stem and the partition being effected by inserting the stem through the axial opening with the slots in the transverse partition, and then turning the stem into a position where the respective tapering surfaces of the head and of the opening engage each other for their interaction during the reverse travel of the device.

The abovedescribed connection between the housing and the tip provides for reliable fixing of the tip on the housing throughout the hole-drilling cycle, and also for rapid and easy detaching of the tip from the housing, upon the device having been retracted from the hole.

The invention will be further described in connection with an embodiment thereof, with reference being had to the accompanying drawings, wherein:

DESCRIPTION OF THE PREFERRED EMBODIMENT

Figure 1:
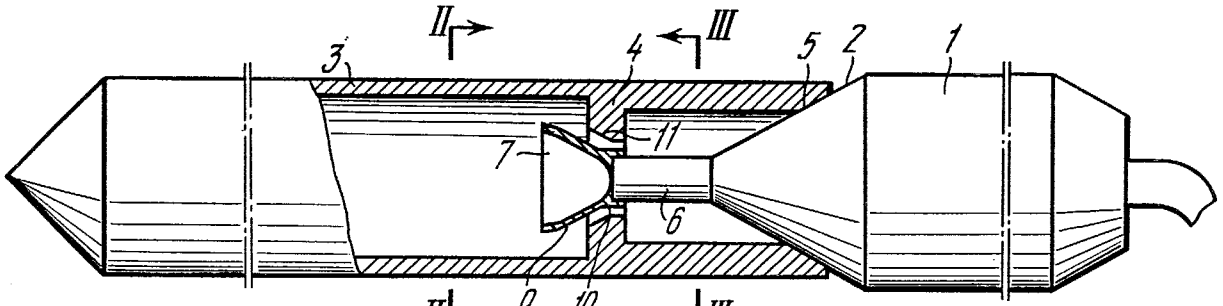
FIG. 1 is general partly longitudinal sectional view of a percussive action device for drilling a hole in soil, in accordance with the invention.

Referring now in particular to the appended drawings, FIG. 1, the percussive action device for drilling holes in soil, embodying the invention, comprises a housing 1 with a conically pointed head. The conical or tapering surface 2 of the housing 1 snugly receives thereon a hollow tip 3 with the pointed head portion. The head portion of the tip 3 is that portion thereof which directly engages the face of the hole being drilled.

The tip 3 is provided in the tail portion thereof with a transverse partition 4 detachably connected with the head portion of the housing 1.

The percussive action device can incorporate any suitable known per se drive means, providing for feeding the device into the hole being drilled and for withdrawal of the device to the mouth of the hole upon the latter having been formed. In the herein disclosed practical embodiment of the percussive action device for drilling holes in soil a pneumatic drive is incorporated.

The tip 3 is made hollow, for the purpose of weight reduction. The shape of the tip in cross-section is arbitrary; however, a cylindrical shape is preferred. The diameter and length of the tip 3 are selected to correspond to the diameter of the hole to be drilled. With the diameter of the tip 3 increasing, its length is preferably increased, too, to provide for better stability of the percussive action device in the hole and to facilitate the maintaining of a predetermined direction or drilling the hole.

More often than not, it is expedient that the external diameter of the tip 3 should be somewhat smaller than the external diameter of the housing 1. This is essential to ensure better engagement of the housing with the wall of the hole, and thus to preclude efforts tending to detach the housing 1 from the tip 3 in operation of the device.

In the area where the tip 3 is seated on the tapering surface 2 of the housing 1 the internal surface 5 of the tip 3 is likewise tapering, the taper angle of the contacting surfaces 5, 2, respectively, of the tip 3 and of the housing 1 being the same. This provides for reliable connection between the tip 3 and the housing 1 while the hole is being drilled.

Figure 2:
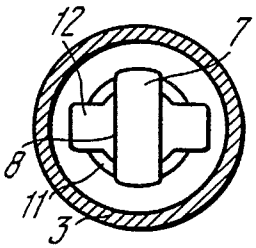
FIG. 2 is a sectional view taken on section line II—II of FIG. 1.

The housing 1 is provided in the head portion thereof with an axially projecting stem 6 with a tapering head 7, the latter being attached to the stem 6 by its narrow portion. The tapering head 7 has cut therein parallel flats 8 (FIG. 2) and also has tapering surfaces 9.

Figure 3:
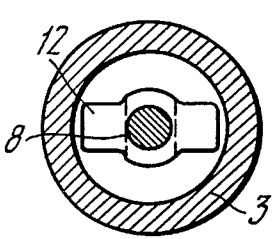
FIG. 3 is a sectional view taken on line III—III of FIG. 1.

The transverse partition 4 of the tip 3 has a tapering axial opening 10 with a tapering surface 11. The axial opening 10 has further cut therein slots 12. The slots 12 (FIGS. 2, 3) has a contour providing for the passage therethrough of the widest portion of the tapering head 7 in a predetermined angular position of the latter.

Figure 4:
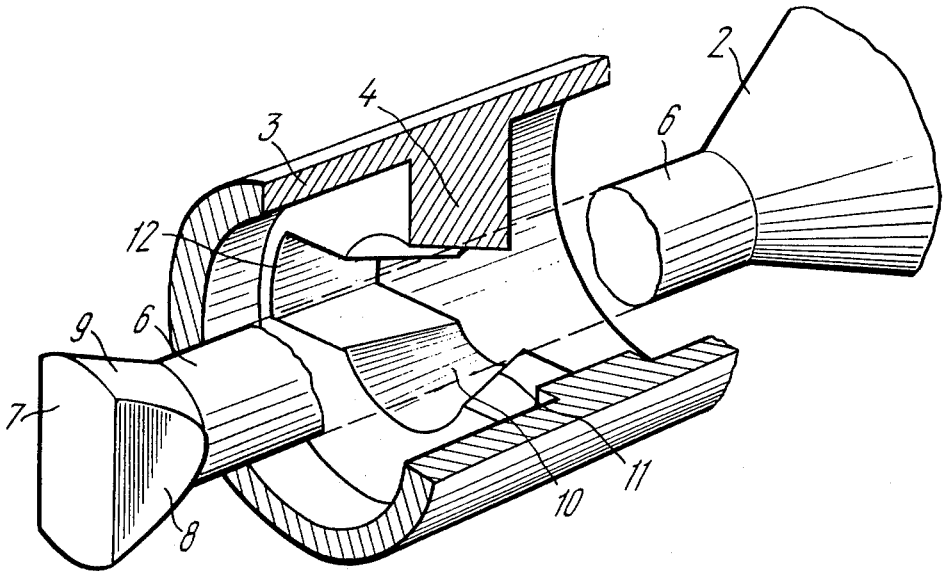
FIG. 4 shows in more detail a perspective view of the area of detachable connection between the stem with the head and the transverse partition.

A perspective view of the area of the detachable connection between the partition 4 and the head portion of the housing 1 can be seen in more detail in FIG. 4.

The tip 3 is mounted on the housing 1, as follows. The tip 3 is seated by its tail portion onto the tapering surface 2 of the housing 1, with the slots 12 of the axial opening 10 in the transverse partition 4 being aligned with the widest portion of the tapering head 7, so that the latter can be inserted jointly with the stem 6 through this axial opening 10 with the slots 12. Then the tip 3 and the housing 1 are rotated relative to each other (through about 90°), for the tapering surfaces 9, 11, respectively, of the tapering head 7 and of the axial opening 10 to face each other, as it is shown in FIG. 4.

The length of the stem 6 is such that when the tip 3 is seated on the housing 1, the tapering surfaces 9 and 11, respectively, of the tapering head 7 and of the partition 4 do not engage each other. Throughout the hole-drilling operation these surfaces are not expected to engage each other, either, this being necessary to ensure than an impact is transmitted from the housing 1 to the tail portion of the tip 3.

When the percussive action device for drilling holes in soil is retracted from a hole, i.e. during the reverse travel of the device, the tapering surfaces 9, 11 of the tapering head 7 and the transverse partition 4, respectively, engage each other, providing for recovery of the tip from the drilled hole.

The herein disclosed percussive action device for drilling holes in soil operates, as follows.

Prior to drilling a hole, the tip 3 is seated by its tapering surface 5 onto the pointed portion of the housing 1. Depending on the actual operating conditions, the tip 3 is either placed by its pointed end directly onto the soil, or else inserted into a pre-formed hole. Then the percussive-action device is energized, and the hole is drilled. Repeated impacts are transmitted by the housing 1 to the tip 3 which penetrates the soil, guiding the progress of the housing 1. The peripheral surface of the wall of the housing 1 following the tip 3 engages the soil and shapes the wall of the hole. Upon the hole of a predetermined length having been drilled, the motion of the percussive action device for drilling holes in soil is reversed, whereby the tapering surfaces 9 and 11, respectively, of the tapering head 7 and of the transverse partition 4 engage each other, providing for recovery of the tip from the hole that has been formed.

Following the withdrawal of the percussive action device for drilling holes in soil from the hole, the tip 3 can be easily detached from the housing 1.

What is claimed is:

1. A pneumatic device for making holes in soil by compaction thereof comprising, a driving cylindrical impact housing having a conical head portion, a tubular tip releasably mounted axially forwardly of said housing, said tip having a conical point and an internal transverse partition to which said housing is releasably connected for driving of said tip axially by said impact housing, said conical head portion extending inwardly of said tubular tip, said tip having a tail portion open to receive said conical head portion and on which said housing seats, connection menas on said conical head portion for releasably connecting said housing to said partition, said partition having a central opening for inserting said connection means therethrough and rotating it in one direction for connecting to said partition after insertion of said connection means into said opening.

2. A pneumatic device for making holes in soil by compaction according to claim 1, in which said connection means comprises an axial stem on said housing lateral projections, said opening having lateral slots through which said projections are inserted, and said projections releasably fixing the stem to said partition upon angular rotation of said housing and said projections being disposed out registry with said slots.

* * * * *